US006162019A

United States Patent [19]

Effinger

[11] Patent Number: 6,162,019

[45] Date of Patent: Dec. 19, 2000

[54] LOAD TRANSFER MECHANISM FOR A TURBINE DISK

[75] Inventor: Michael R. Effinger, Fayetteville, Tenn.

[73] Assignee: The United States of America as represented by the Administrator of the National Aeronautics and Space Administration, Washington, D.C.

[21] Appl. No.: 09/190,784

[22] Filed: Nov. 12, 1998

[51] Int. Cl.[7] ..... F01D 5/02

[52] U.S. Cl. ..... 416/230; 416/229 A; 416/244 A

[58] Field of Search ..... 416/230, 229 A, 416/229 R, 244 A, 204 A

[56] References Cited

U.S. PATENT DOCUMENTS 4,363,602 12/1982 Martin ..... 416/230
5,205,716 4/1993 Georges et al. ..... 416/229 A

OTHER PUBLICATIONS

Mitch Petervery, Boeing, Rocketdyne Division, Nov. 14, 1997 Wayne Lorandeau, DuPont Lanxide, Nov. 14, 1997 (See Enclosure).

*Primary Examiner*—Edward K. Look
*Assistant Examiner*—Richard Woo
*Attorney, Agent, or Firm*—Robert L. Broad, Jr.

[57] ABSTRACT

A load transferring system wherein a composite turbine disk mounted on a shaft is in contact with a backup disk which is secured to the shaft. The turbine disk is made of layers of woven carbon fibers held in a rigid configuration in a ceramic matrix. The composite disk has a plurality of lugs which have trapezoidal cross sections when cut by planes which are perpendicular to each other, with both planes being normal to the disk. The backup disk is provided with recesses which are the negative of the trapezoidal lugs to lock the two disks together. A second backup disk may be secured to the shaft to secure the composite turbine disk between the backup disks.

4 Claims, 2 Drawing Sheets

LOAD TRANSFER MECHANISM FOR A TURBINE DISK

ORIGIN OF THE INVENTION

This invention was made by an employee of the United States Government and may be manufactured and used by or for the Government without the payment of any royalties.

FIELD OF THE INVENTION

This invention relates to systems for transferring loads from a turbine shaft to a turbine disk and vice versa.

BACKGROUND OF THE INVENTION

In turbomachinery it is usually necessary to attach turbine disks to a turbine shaft for either having the shaft drive the disk or the disk drive the shaft. Composite disks offer better results in some operations but are more sensitive to stress risers than metallic disks. Thus, it is sometimes necessary to secure a backup disk, having the required strength, to the shaft and provide some means for locking the composite disk to the backup disk.

Bolts have been used for locking the backup disk to the composite disk but the bolt holes in the composite disk are stress raisers which can eventually lead to failure of the composite disk. Other methods of attaching the backup disc to the composite turbine disk have other problems.

SUMMARY OF THE INVENTION

A load transferring system wherein a composite turbine disk mounted on a shaft is in contact with a backup disk which is secured to the shaft. The turbine disk is made of layers of woven graphite fibers held in a rigid configuration in a ceramic matrix. The composite disk has a plurality of lugs which have generally trapezoidal cross sections when cut by planes which are perpendicular to each other, with both planes being normal to the disk. The backup disk is provided with recesses which are the negative of the trapezoidal lugs to lock the two disks together. A second backup disk may be secured to the shaft to secure the composite turbine disk between the backup disks.

DETAILED DESCRIPTION OF THE INVENTION

Figure 1:
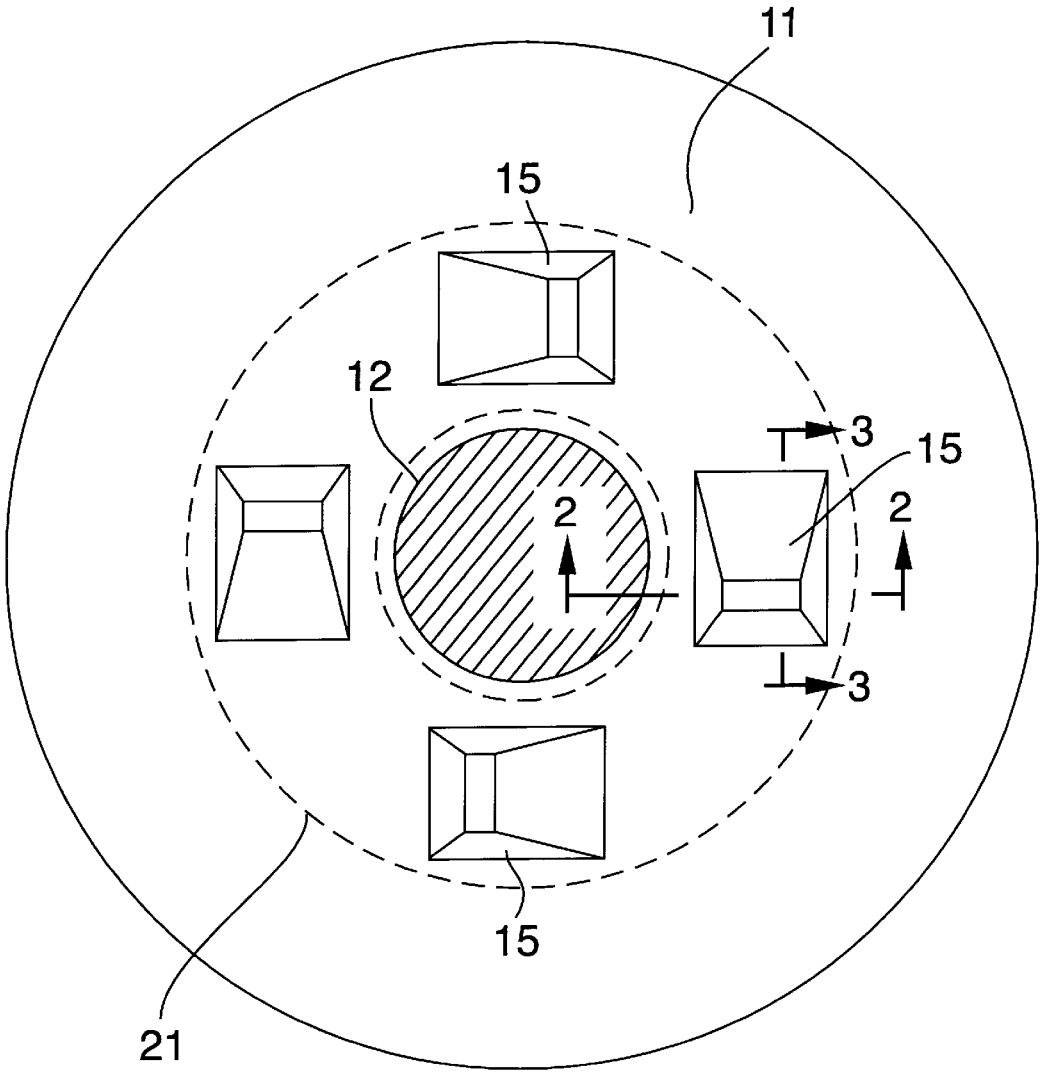
FIG. 1 is a view of one side of the turbine disk showing the lugs which lock the turbine disk to a backup disk.

Referring now in detail to the drawings there is shown in FIG. 1 the face of a composite turbine disk 11 mounted on a shaft 12. Depending on the usage of the apparatus, the shaft 12 may drive the disk 11 or the disk 11 may drive the shaft 12. The composite disk is made up of a plurality of layers of a polar weave of carbon fibers. A polar weave is well known and consists of fibers (not shown) running in an annular direction woven with fibers running in radial directions. The layers of fibers are held in a rigid configuration in a ceramic matrix.

Figure 2:
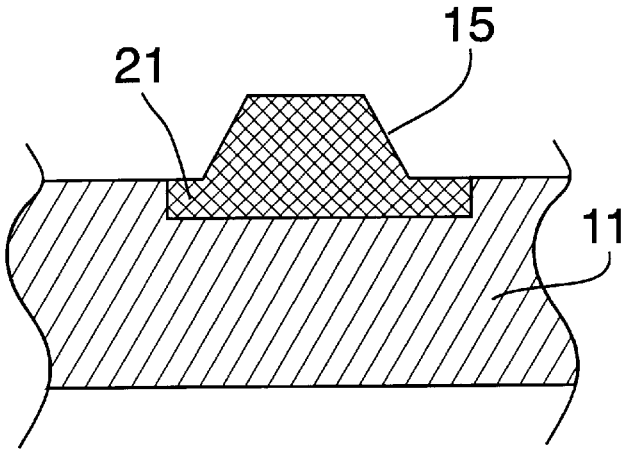
FIG. 2 is an enlarged fragmentary view taken on line 2—2 of FIG. 1 showing the frontal view of the lug.
Figure 3:
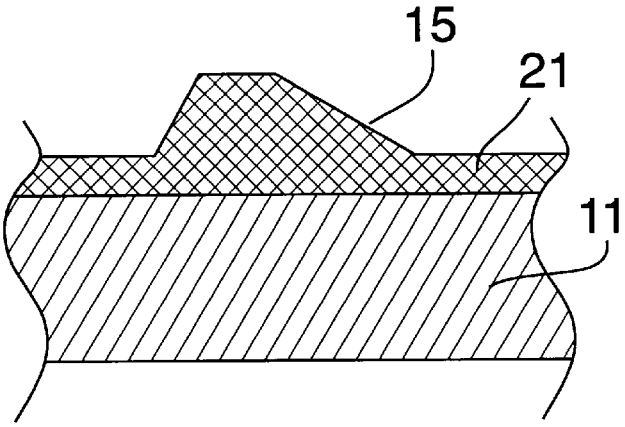
FIG. 3 is an enlarged fragmentary view taken on line 3—3 of FIG. 1 showing a side view of the lug.

The composite disk 11 is provided with a plurality of lugs 15 best shown in FIG. 1. These lugs 15 have generally trapezoidal configurations which when cut by a first plane parallel to the axis of the shaft 12 and when cut by a second plane perpendicular to the first plane, with both planes being normal to the disk and passing trough the lug. FIG. 2 shows the trapezoidal configuration of the lug when cut by the first plane. FIG. 3 shows the configuration of he lug 15 when cut by the second plane. This configuration offer the least stress raisers which can cause a failure of the composite disk 12.

Figure 4:
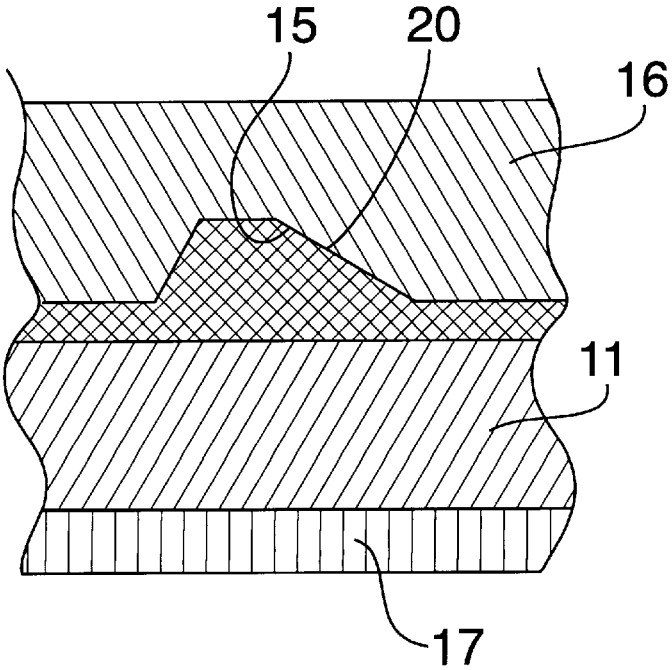
FIG. 4 is an enlarged fragmentary view showing the composite disk sandwiched between two backup disks 16 and 17.

To lock the composite disk 11 to the shaft 12, a pair of backup disks 16 and 17 (FIG. 4) are secured to the shaft 12 on opposite sides of the composite disk 11. One of the disks, 16, is provided with a recess 20 which is a negative of the lug 15 so that the lug fits snugly in the recess 20. Both of the backup disks 16 and 17 are attached to the shaft 12 so that, when a load is transmitted to or from the composite disk, the disks 11 and 16 cannot move away from each other.

If desired for greater strength and resistance to delamination, the lug 15 may be part of a three dimensionally woven insert 21 which is embedded in the composite disk 11 and held there by the ceramic matrix. The insert 21 consists of a thick layer of three dimensionally woven carbon fibers in a ceramic matrix. Three dimensional weaving is well known those skilled in the art of weaving.

The ceramic matrix is formed by compressing the layers of woven carbon fibers into a heated preform and infiltrating the preform with methyltrichlorosilane. The preform is then further heated to decompose the methyltrichlorosilane to silicon carbide.

While a composite disk is described above, the disk may be made of a ceramic material. Methods of casting ceramic materials are well known.

Also, it should be understood that the use of carbon fibers specified above includes the use of either regular carbon fibers or graphite fibers.

What is claimed is:

1. A load transferring system, comprising:

a turbine disk mounted on a turbine shaft having an axis, said turbine disk consists of a two-dimensional composite material, said turbine disk also having a load-transferring lug attached to one side thereof, said lug having generally trapezoidal cross sectional configurations when cut by a pair of planes perpendicular to each other and parallel to the shaft axis, said lug consists of a three-dimensional composite material, a backup disk attached to said turbine shaft, said backup disk having a recess which is the negative of said lug on said turbine disk for receiving said lug to lock said turbine disk to said backup disk, and means attached to said shaft for holding said backup disk and said turbine disk in contact with each other.

2. A load transferring system as recited in claim 1 wherein said composite material consists of carbon fibers in a ceramic matrix.

3. A load transferring system as recited in claim 1 wherein said composite material consists of graphite fibers in a ceramic matrix.

4. A load transferring system, comprising:

a turbine disk mounted on a turbine shaft having an axis, said turbine disk consists of a two-dimensional composite material, a load-transferring lug integral with one side of said turbine disk, said load-transferring lug consists of a three-dimensional composite material such that composite fibers extend in a direction parallel to the axis, a backup disk attached to said turbine shaft, said backup disk having a recess which is the negative of said lug on said turbine disk for receiving said lug to lock said turbine disk to said backup disk, and means attached to said shaft for holding said backup disk and said turbine disk in contact with each other.

* * * * *